US006273739B1

(12) United States Patent
Konno et al.

(10) Patent No.: US 6,273,739 B1
(45) Date of Patent: Aug. 14, 2001

(54) MEMORY CARD CONNECTOR

(75) Inventors: Takeshi Konno, Higashi Ibaraki-Gun; Yoshinori Ota, Hitachi Naka, both of (JP)

(73) Assignee: Mitsumi Electric Co., Ltd. (JP)

( * ) Notice: Subject to any disclaimer, the term of this patent is extended or adjusted under 35 U.S.C. 154(b) by 0 days.

(21) Appl. No.: 09/573,728

(22) Filed: May 18, 2000

(30) Foreign Application Priority Data

May 31, 1999 (JP) ..... 11-151456

(51) Int. Cl.[7] ..... H01R 13/62
(52) U.S. Cl. ..... 439/331
(58) Field of Search ..... 439/331, 630, 439/326

(56) References Cited

U.S. PATENT DOCUMENTS 3,771,109 * 11/1973 Bruckner et al. ..... 439/331
5,120,238 * 6/1992 Marks et al. ..... 439/331
5,986,891 * 11/1999 Sugitomo ..... 439/331
5,996,891 * 12/1999 Braun ..... 439/326

* cited by examiner

*Primary Examiner*—Neil Abrams
*Assistant Examiner*—Phuong K T Dinh
(74) *Attorney, Agent, or Firm*—Morrison Law Firm

(57) ABSTRACT

A memory card connector 10, which can be locked easily with a small size holder cover 20, includes a housing 11 for a memory card; the holder cover 20 covering the memory card; a plurality of connection terminals 14, are built into the housing so that one end is opposite a contact part of the memory card housed inside the housing and is exposed at the surface of the housing and the other end protrudes from an edge of the housing, the holder cover is supported at one side edge which is sideways with respect to the longitudinal direction of the connector, so that, by pivoting around a rotation shaft 15 provided on one side edge of the housing, the holder cover 20 can be opened and closed with respect to housing 11.

9 Claims, 7 Drawing Sheets

MEMORY CARD CONNECTOR

BACKGROUND TO THE INVENTION

The present invention relates to a connector for a memory card, such as a Subscriber ID Entity Module (SIM) card and the like.

Referring to FIGS. 6 through 10, there is shown a construction for this type of memory card connector of the prior art.

Referring to FIGS. 6 through 10(A) and 10(B), a memory card connector 1 is constructed from a housing 2 and a holder cover 3. Housing 2 is provided on its upper surface with a space 2*a*, which is for receiving a SIM card 4 as the memory card. Housing 2 is also provided with a perimeter wall 2*b* which surrounds space 2*a*.

In addition, housing 2 is provided with a plurality of connection terminals 5 (in the drawing, there are three). The area near one end of each of connection terminals 5 protrudes at the upper surface of housing 2. Each of the other ends protrudes in a row at the opposing edges of housing 2 (in the drawing, the left and right edges).

Furthermore, referring to FIG. 6, housing 2 is provided with a rotation shaft 2*c*, which protrudes outward (in the upward and downward direction of FIG. 6) from both ends of the right edge in FIG. 6.

Holder cover 3 is provided with a hinge part 3*a*, which latches onto rotation shaft 2*c*, which is provided on the housing. Holder cover 3 has a construction wherein by hinge part 3*a* latching onto rotation shaft 2*c*, holder cover 3 can rotate with respect to housing 2.

Furthermore, holder cover 3 is provided with memory card latching tabs 3*b* and locking tabs 3*c*, which extend downward from both side edges (the upper and lower edges in the figure) and are further extended inward.

Hinge part 3*a* is constructed from a slot 3*d*, which extends towards both side edges of holder cover 3. Hinge part 3*a* is constructed so that rotation shaft 2*c* is capable of sliding within slot 3*d*.

According to this, holder cover 3 is brought from the open position shown in FIG. 6 and FIG. 7(A) to the closed position shown in FIG. 9 by rotating around rotation shaft 2*c* as shown in FIG. 8. Furthermore, referring to FIG. 9, while rotation shaft 2*c* slides within slot 3*d*, holder cover 3 is moved towards the right with respect to housing 2, and it is brought to the locked position shown in FIGS. 10(A) and (B).

Referring to FIGS. 10(A), 10(B), in this locked position, locking tab 3*c*, which is provided on holder cover 3, latches onto a latching part 2*d*, which is provided on the side edges of housing 2. As a result, holder cover 3 is locked onto housing 2.

According to memory card connector 1 with this construction, first, as shown in FIG. 6, holder cover 3 is in an open position in which holder cover 3 is open approximately 180 degrees with respect to housing 2. Memory card 4 is set on the inside of memory card latching tabs 3*b* of holder cover 3 (refer to FIG. 7(A)).

Next, referring to FIG. 8, as indicated by letters A, B, C, D, E, by rotating holder cover 3 in sequence with respect to housing 2, holder cover 3 is brought to a closed position as shown in FIG. 9.

Next, referring to FIG. 9, holder cover 3 slides with respect to housing 2 in the direction indicated by arrow X. By the latching of locking tab 3*c* of holder cover 3 onto latching part 2*d* of housing 2, holder cover 3 is locked to housing 2.

At this time, the contact part of memory card 4, which has been set inside holder cover 3, contacts one end of the corresponding connection terminal 5, which is provided on housing 2. In addition, the contact part of memory card 4 is pressed against one end of connection terminal 5 by holder cover 3.

In this manner, memory card 4, which is housed inside memory card connector 1, which is installed in various devices, such as telephones, telecommunication devices and the like, can be connected with these various devices.

With memory card connector 1 having this construction, holder cover 3 is supported in a manner which allows for rotation around rotation shaft 2*c*, which is sideways with respect to the insertion direction of connector 1. Therefore, because holder cover 3 is provided with locking tabs 3*c* on both side edges, the entire holder cover 3 becomes large, and the weight increases.

Furthermore, when receiving memory card 4, after bringing holder cover 3 to the closed position by rotating around rotation shaft 2*c*, holder cover 3 is locked to housing 2 by sliding holder cover 3 in the horizontal direction and bringing it to the lock position. As a result, for the anchoring of memory card 4, two motions of pivoting and sliding of holder cover 3 are necessary. As a result, the operational quality was not very good.

Furthermore, with holder cover 3, only its hinge part 3*a* is latched to rotation shaft 2*c* on both side edges. While holder cover 3 is being rotated from the open position to the closed position, rotation shaft 2*c* can become shifted within slot 3*d* on one side of holder cover 3. As a result, referring to FIG. 12, holder cover 3 can become slanted, and holder cover 3 is no longer capable of moving to the closed position.

OBJECT AND SUMMARY OF THE PRESENT INVENTION

Learning from the above points, the object of the present invention is to provide a memory card connector, wherein the holder cover can be constructed in a small size and can be easily locked to the housing.

The invention provides the advantage that the cover is pivoted along one longitudinal side of an elongated housing in which an elongated memory card is received. In this manner, the cover pivots about an axis which is parallel to the parallel placed axes of the holer and the memory card, the result of which is the cover moving transversely across the memory card in moving to closed position. The cover thereby can be more conveniently user digitally manipulated between open and closed positions and because it is pivoted from a side of the holder, reduced cover size easily is achieved.

The above object can be achieved with the present invention of a memory card connector, the memory card connector being constructed from: a housing, which houses a memory card; a holder cover, which covers the memory card housed inside the housing; a plurality of connection terminals, which are built into the housing so that one end is opposite a contact part of said memory card housed inside said housing and is exposed at the surface of said housing and the other end protrudes from an edge of said housing, wherein: at one side edge which is sideways with respect to the longitudinal direction of said connector, said holder cover is supported so that, by pivoting around a rotation shaft provided on one side edge of said housing, said holder cover can be opened and closed with respect to said housing.

According to the memory card connector of the present invention, preferably, the above holder cover is provided on its other side edge with a hook of an elastic material which can latch to a latching part provided on the other side edge of the housing.

According to the memory card connector of the present invention, preferably, the above hook is formed in a unitary manner with the holder cover.

According to the memory card connector of the present invention, preferably, the above holder cover is supported so that it can slide along the above rotation shaft; and when the above holder cover slides along the rotation shaft to a lock position, latching tabs of the holder cover latch to projecting parts of the housing.

According to the memory card connector of the present invention, preferably, the above holder cover is provided with a window for finger latching at the time of opening and closing.

According to the memory card connector of the present invention, preferably, the above holder cover is provided with a protruding part which is adjacent to the above window.

With the above construction, the holder cover is capable of pivoting with respect to the housing at one side edge which is sideways with respect to the connector insertion direction. As a result, the longitudinal length of the connector of the holder cover only has to be a length necessary to cover the connection terminals, which are opposite the contact part of the memory card, at the part which is exposed to the surface of the housing.

Therefore, a holder cover which can be miniaturized to the minimum area and can be formed to have a light weight.

Furthermore, the hinge part of the holder cover latches onto the rotation shaft for a comparatively long distance. As a result, when holder cover slides along the rotation shaft, or when it rotates around the rotation shaft, the holder cover does not become shifted diagonally, and it is securely guided in a parallel manner along the rotation shaft. The anchoring of the memory card can be conducted securely.

In the situation where the above holder cover is provided on the other side edge with a hook, this hook being made of elastic material and being capable of latching onto the latching part which is provided on the other side edge of the housing, by closing the holder cover onto the housing, this hook latches onto the latching part of the housing. As a result, locking of the holder cover can be conducted with one motion, and the operational quality is improved.

In the situation where the above described hook is formed in a unitary manner with the holder cover, the number of parts is reduced, and the part costs and the assembly costs can be reduced.

The above described holder cover is supported so that the holder cover can slide along the above described rotation shaft. In the situation where when the above holder cover slides along the rotation shaft to a lock position, the latching tabs of the holder cover latches onto projecting parts of the housing, after the holder cover is closed onto the housing, by sliding along the rotation shaft, it is brought to the locked position, and by the latching of the latching tabs onto the projecting parts, locking can be securely conducted.

In the situation where the above described holder cover is provided with window for finger latching at the time of opening and closing and/or with a protruding part adjacent to this window, when the user opens the holder cover, by placing the finger in the window or in the space between the window and the protruding part, the holder cover is securely held, and the holder cover can be opened easily.

The above, and other objects, features and advantages of the present invention will become apparent from the following description read in conjunction with the accompanying drawings, in which like reference numerals designate the same elements.

DETAILED DESCRIPTION OF THE EMBODIMENTS

Referring to the embodiments shown in the figures, the present invention will be described in detail below.

Referring to FIGS. 1 through 3(A) and (B), there is shown the construction for the first embodiment of the memory card connector according the present invention.

Figure 1:
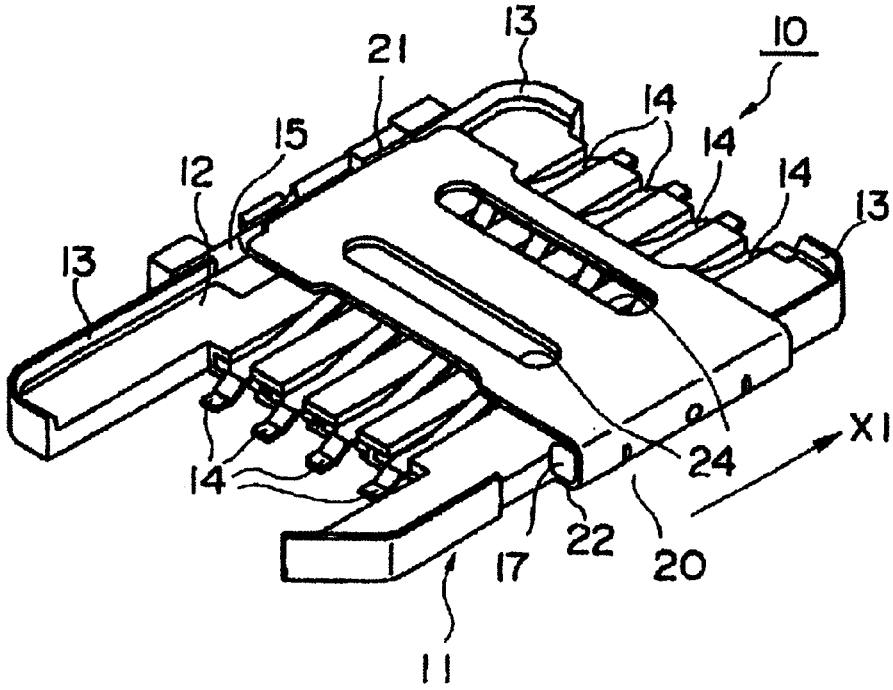
FIG. 1 is a schematic perspective drawing showing the construction of the first embodiment of the memory card connector of the present invention in the lock position.
Figure 2:
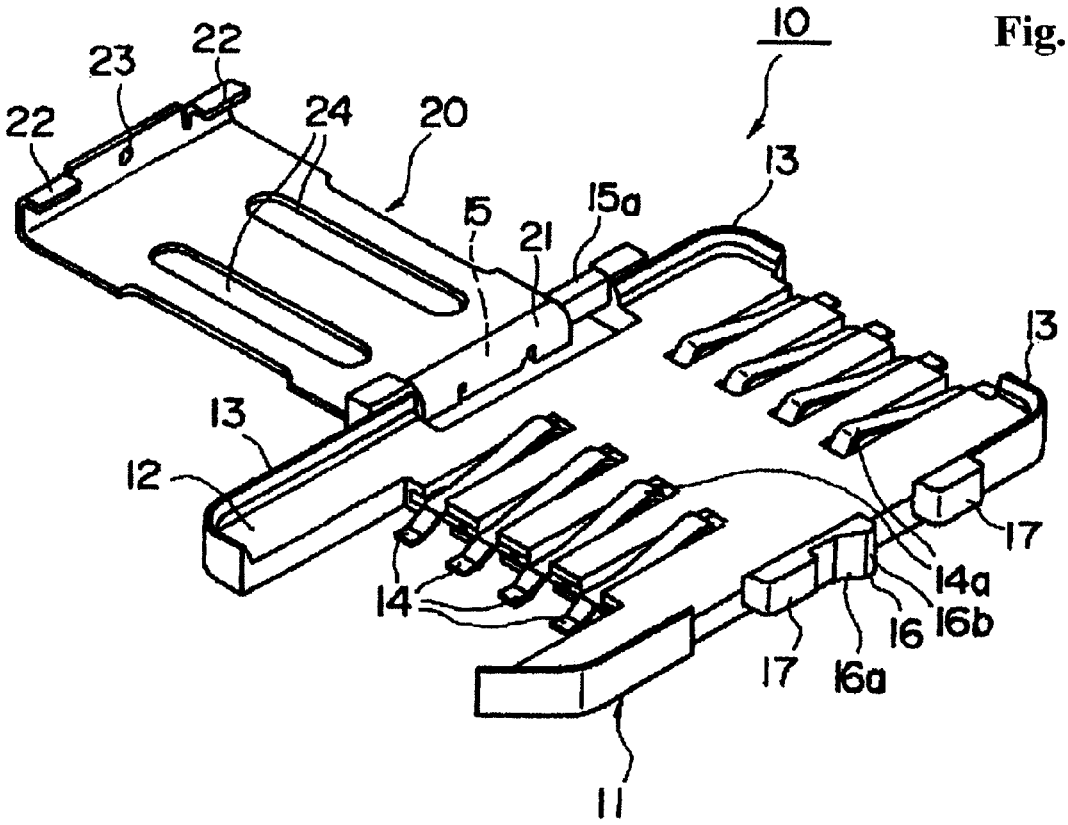
FIG. 2 is a schematic perspective drawing of the memory card connector of FIG. 1 in the open position.

Referring to FIGS. 1 and 2, a memory card connector 10 is constructed from a resin housing 11 and a metal holder cover 20.

Housing 11 is provided on its top surface with a space 12, which is for receiving the SIM card as the memory card. In addition, housing 11 is provided with a perimeter wall 13 which surrounds space 12.

In addition, housing 11 is provided with a plurality of connection terminals 14 (in the figure, there are 4), whose area near one end protrudes at the top surface of housing 11, and each of the other ends protrudes in a row at the opposing edges of housing 11 (in FIG. 1, the edges at left front and right back).

Furthermore, housing 11 is provided with a rotation shaft 15, which extends along one side edge (in FIG. 1, the side edge at the left rear) which is sideways with respect to the longitudinal direction X1 of the connector.

Holder cover 20 is constructed entirely from a metal, elastic material. In addition, on one of its side edges, there is a hinge part 21 which latches with rotation shaft 15 which is provided on housing 11. Holder cover 20 is constructed so that by having hinge part 21 latch with rotation shaft 15, holder cover 20 can rotate with respect to housing 11.

Furthermore, holder cover 20 is provided with a tongue pieces 22 as the latching tab which extends downward from the other side edge (in the figure, the vertical edge) and further extends inwards.

As will be described later, when holder cover 20, in the closed position, slides along rotation shaft 15, tongue piece 22 latches onto a projecting part 17, which is provided on housing 11.

Hinge part 21 extends along rotation shaft 15 of holder cover 20. The cross-section of hinge part 21 is shaped in an approximate U-shape, in which, at the lock position shown in FIG. 1 and at the closed position, the upper region is open. Furthermore, hinge part 21 is constructed so that it can slide along rotation shaft 15.

Rotation shaft 15 is formed with a circular cross-section. In addition, in a region 15*a* which corresponds to the lock position, the cross-section of rotation shaft 15 has a modified shape corresponding to the shape of hinge part 21 of holder cover 20. In the drawing, it is formed in a U-shape.

According to this, only in the closed position does the shape of hinge part 21 conform to the shape of modified shape part 15*a* (the region corresponding to the lock position), and holder cover 20 can slide to the lock position.

Furthermore, holder cover 20 is provided on the other side edge with a protuberance 23 which protrudes towards the inside so that, at the lock position shown in FIG. 1, protuberance 23 can latch onto latching part 16 formed on the other side edge of housing 11.

Protuberance 23 is formed in a unitary manner with holder cover 20, which is of elastic material.

According to this, from the open position shown in FIG. 2, by rotating one side edge around rotation shaft 15, holder cover 20 is brought to the closed position. Hinge part 21 further slides along rotation shaft 15. By the movement of holder cover 20 in the X1 direction of FIG. 1 with respect to housing 11, holder cover 20 is brought to the lock position shown in FIG. 1.

In the lock position shown in FIG. 1, tongue piece 22, which is provided on holder cover 20, latches onto projecting part 17, which is provided on the side edge of housing 11. As a result, holder cover 20 is locked onto housing 11.

At this time, protuberance 23, which is provided on holder cover 20, slides along an incline surface 16*a*, which is provided on latching part 16. When protuberance 23 passes a peak 16*b* of latching part 16, protuberance 23 disengages from latching part 16, and a clicking feel is generated. The locking status is easily known.

Furthermore, referring to FIGS. 1 and 2, holder cover 20 is provided with windows 24 used for latching of fingers during opening and closing.

With the example shown, windows 24 are constructed from two slots, which are parallel to each other and extend perpendicularly with respect to rotation shaft 15.

Memory card connector 10 according to the present invention embodiment is constructed as above. Referring to FIG. 2, for example, the user inserts his fingers into windows 24 of holder cover 20, and by rotating holder cover 20 around rotation shaft 15, holder cover 20 is brought to an open position, in which holder cover 20 is opened approximately 180 degrees with respect to housing 11. In this condition, the user sets the memory card (not shown) within space 12 of housing 11.

Figure 3A:
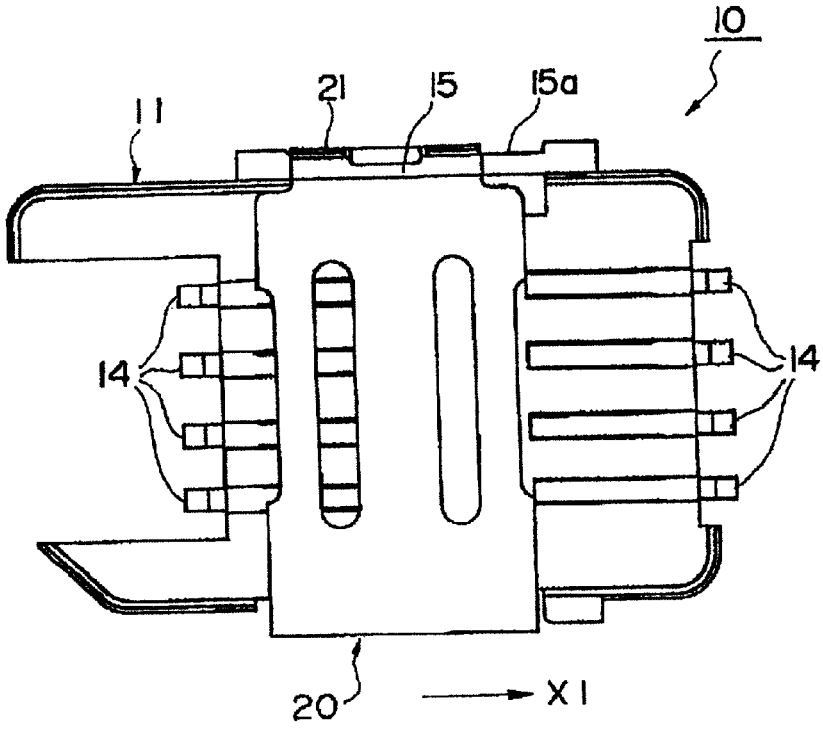
FIGS. 3(A) and FIG. 3(B) are respective plan showings showing the memory card connector of FIG. 1 in a closed position and in a lock position.

Next, by rotating holder cover 20 with respect to housing 11 around rotation shaft 15, holder cover 20 is brought to a closed position shown in FIG. 3(A).

Figure 3B:
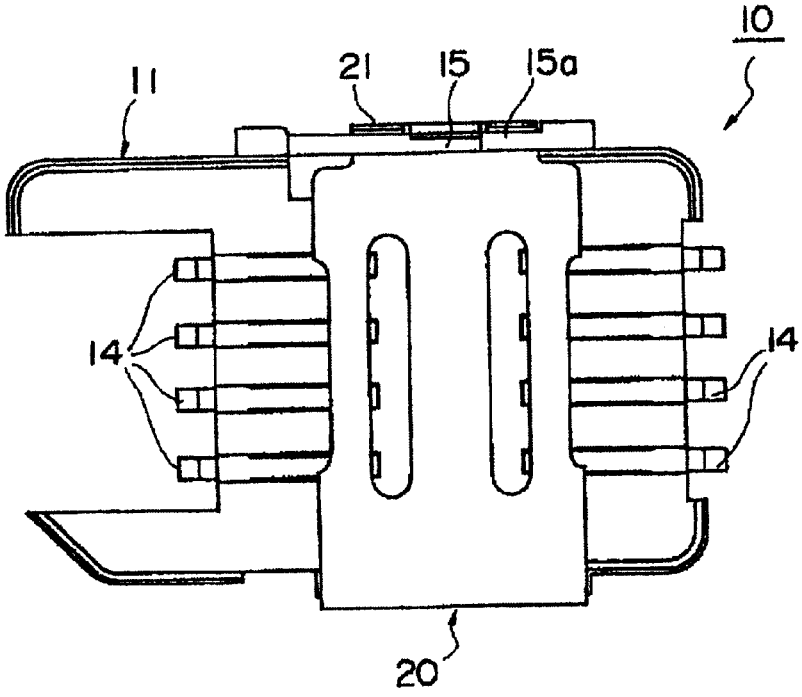

Next, by sliding holder cover 20 along rotation shaft 15 with respect to housing 1 in the arrow X1 direction of FIG. 3(A) and FIG. 1, holder cover 20 is brought to the lock position shown in FIG. 3(B).

Here, by the latching of tongue piece 22 of holder cover 20 onto projecting part 17 of housing 11, holder cover 20 is locked with respect to housing 11.

At this time, with the memory card which has been set inside holder cover 20, the contact part contacts peaks 14*a* of the corresponding connection terminals 14 which are provided on housing 11. In addition, the contact parts are pressed against peaks 14*a* of connection terminals 14 by holder cover 20.

In this manner, for example, the memory card, which is housed inside memory card connector 10 which is built into various devices such as telephones or telecommunication devices, and the like, can be connected with these various devices.

In this situation, holder cover 20 is supported at one side edge in a rotation capable manner with respect to housing 11. Protuberance 23, which is for locking to housing 11, is provided on the other side edge of holder cover 20. As a result, with regard to the insertion direction of the connector, holder cover 20 needs only to be the minimum area that is needed to cover peaks 14*a* of connection terminal 14 which protrude from the surface of space 12 of housing 11. Referring to the figure, holder cover 20 only needs to be the length between peaks 14*a* for each of the sets of the two sets of connection terminals 14. Therefore, referring to FIGS. 6 through 10, compared to memory card connector 1 which is provided with a holder cover 3 which is supported in a rotatable manner to the edge of housing 2, holder cover 20 can be greatly shortened with regard to the connector insertion direction, or, in other words, the direction of rotation shaft 15. Holder cover 20 can be constructed in a small size and in a light weight.

Furthermore, in this situation, because with holder cover 20, its hinge part 21 latches onto rotation shaft 15 for a comparatively long distance, when holder cover 20 slides along rotation shaft 15, or when it rotates around rotation shaft 15, holder cover 20 does not become shifted diagonally with respect to rotation shaft 15. Holder cover 20 is guided securely parallel along rotation shaft 15. The anchoring of the memory card can be conducted securely.

Referring to FIGS. 4(A), 4(B) and 5(A), 5(B), a second embodiment of a memory card connector of the present invention is shown.

As seen from these Figs., memory card connector 30 has approximately the same construction as memory card connector 10 shown in FIGS. 1 through 3(A), 3(B). However, they differ in their constructions in the following points.

Metal holder cover 31 is supported in a rotatable manner around rotation shaft 15, but is supported in a manner which does not allow for sliding along rotation shaft 15.

Furthermore, instead of window 24 as in memory card connector 10 of FIGS. 1 through 3(A), 3(B), holder cover 31 is equipped with a window 32, provided towards the other side edge, and a protruding part 33, which is adjacent to window 32 and which is formed expanding upward.

Figure 4A:
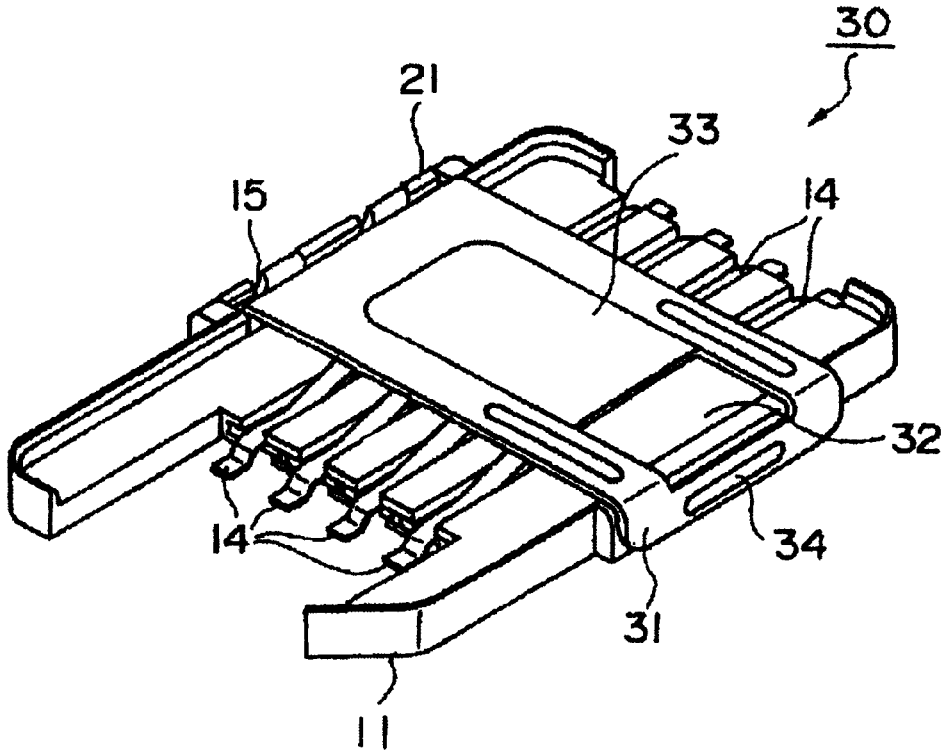
FIGS. 4(A) and FIG. 4(B) are respective perspective and side view partly in section of a second embodiment of the memory card connector of the present invention, same being in the lock position.
Figure 4B:
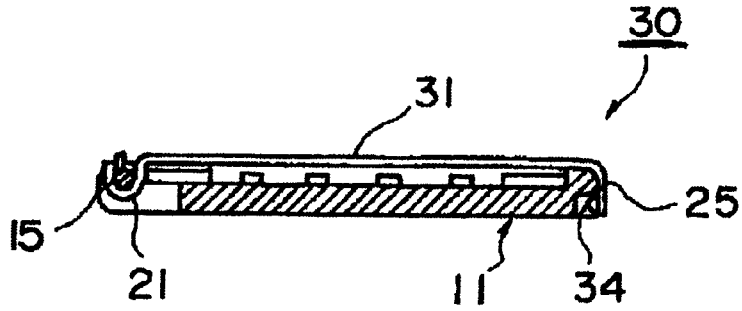

Furthermore, referring to FIG. 4(A), holder cover 31 is equipped with a hook 34 which protrudes inward so that, when holder cover 31 is rotated around rotation shaft 15 and is closed onto resin housing 11 (closed position), hook 34 latches onto latching part 25, which is formed as a structure recess on the other side edge of housing 11. According to this, when holder cover 31 is brought to a closed position, hook 34 latches onto latching part 25, and as a result, holder cover 31 can be locked onto housing 11.

Figure 5A:
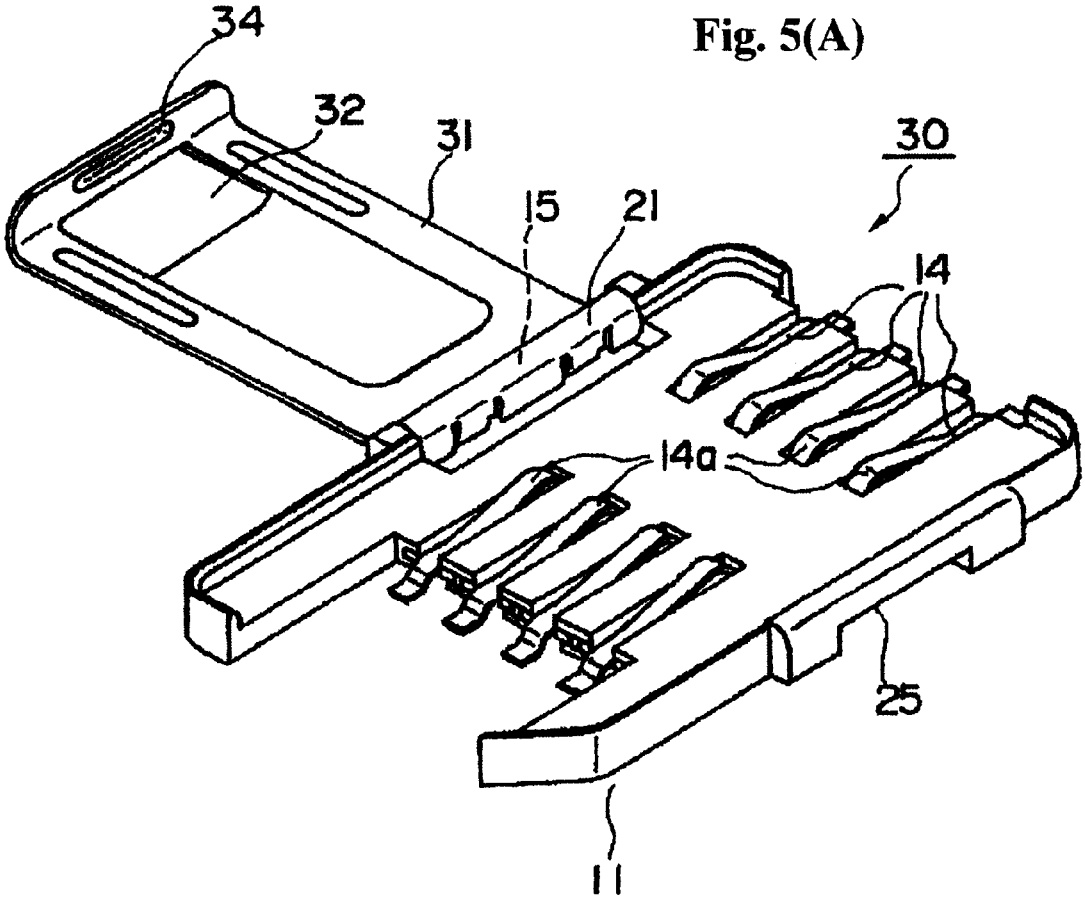
FIGS. 5(A) and FIG. 5(B) are views similar to FIGS. 4(A) and 4(B) but with the memory card connector in open position.
Figure 5B:
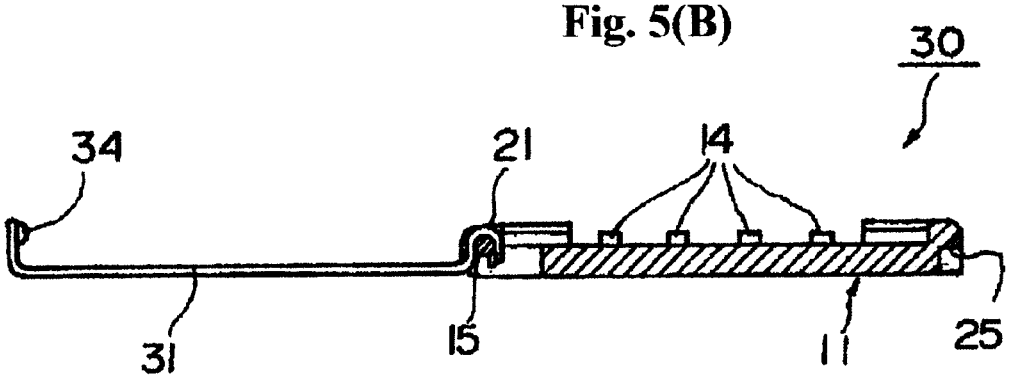
Figure 6:
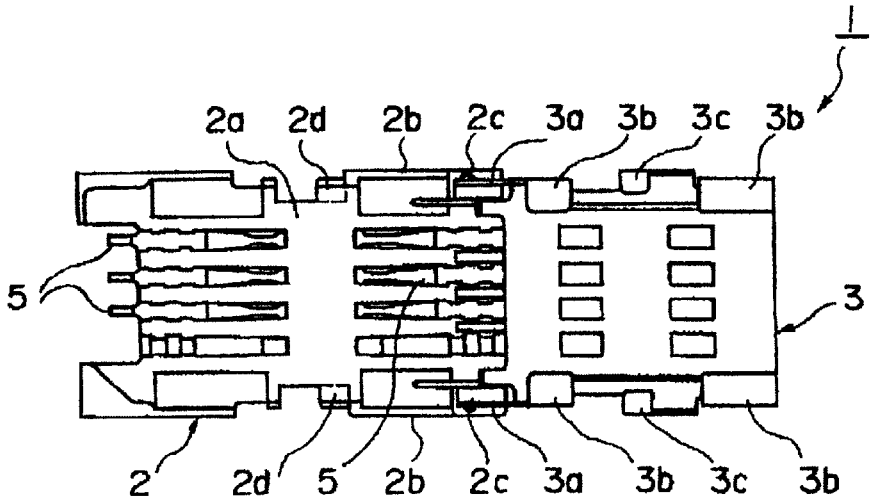
Fig. 6 PRIOR ART
FIG. 6 is a plan view of one example of the memory card connector of the prior art in the open position.
Figure 7A:
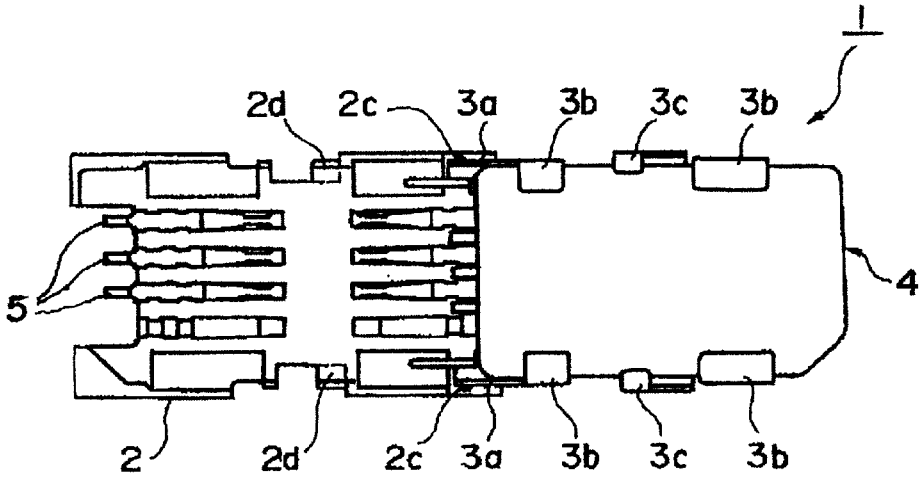
Fig. 7(A) PRIOR ART
FIGS. 7(A) and 7(B) are plan and side views of the memory card connector of FIG. 6 in the open position showing the memory card being inserted.
Figure 7B:
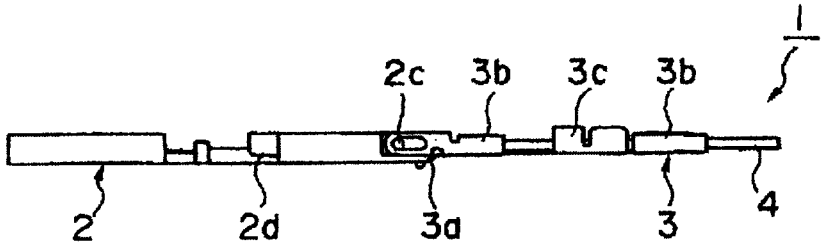
Fig. 7(B) PRIOR ART
Figure 8:
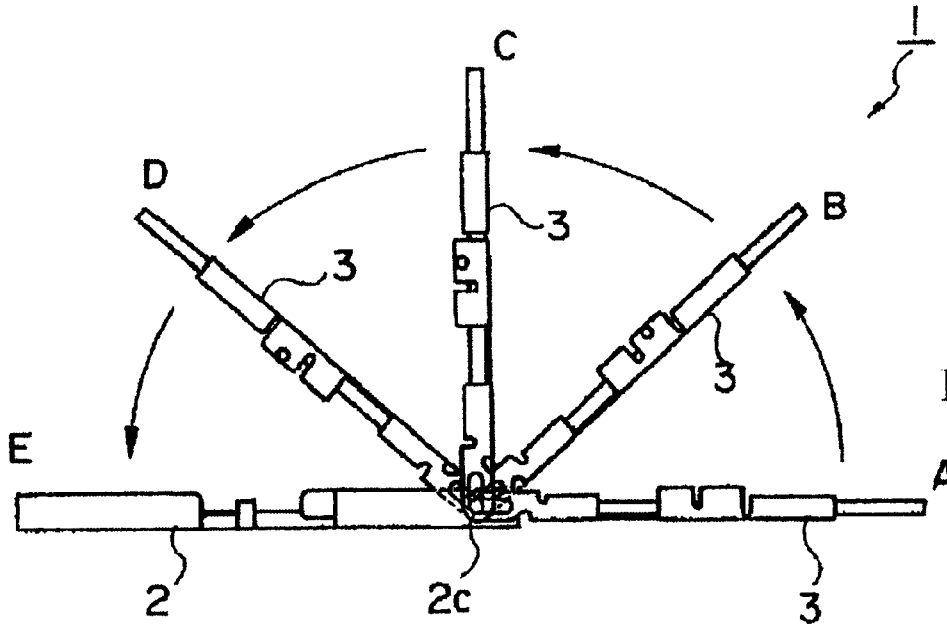
Fig. 8 PRIOR ART
FIG. 8 is a side view showing the pivoting sequence of the holder cover from the open position to the closed position for the memory card connector of FIG. 6.
Figure 9:
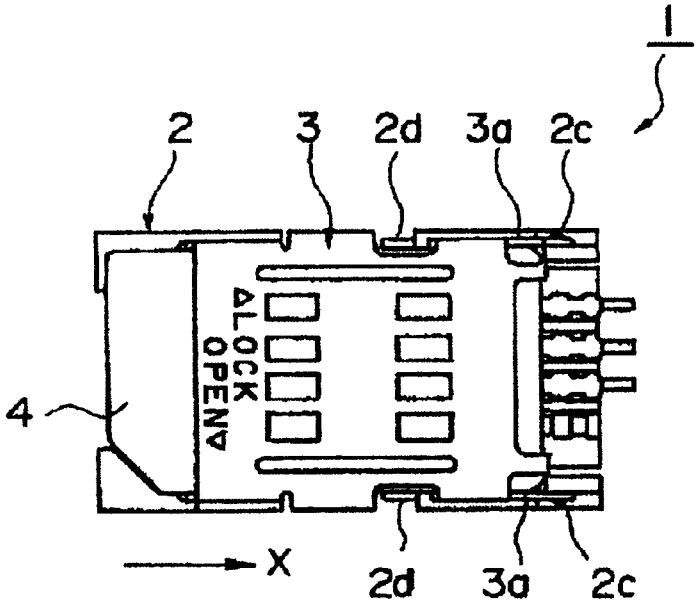
Fig. 9 PRIOR ART
FIG. 9 is a plan view of the memory card connector of FIG. 6 in the closed position.
Figure 10A:
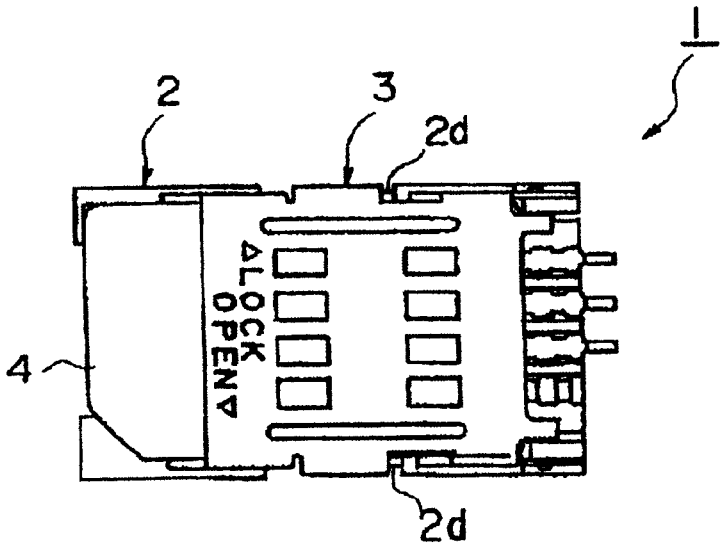
Fig. 10(A) PRIOR ART
FIGS. 10(A) and 10(B) are plan and side view showings of the FIG. 6 memory card connector in lock position.
Figure 10B:
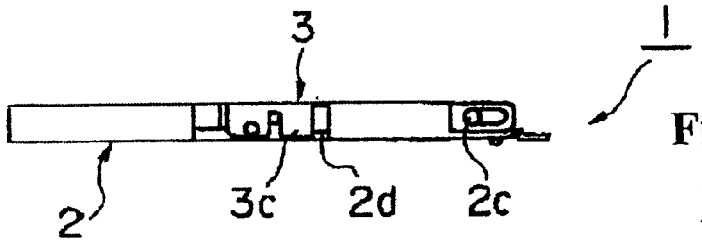
Fig. 10(B) PRIOR ART
Figure 11:
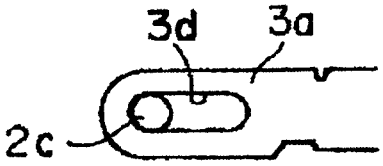
Fig. 11 PRIOR ART
FIG. 11 is a partial expanded side view showing the hinge part of the holder cover and the rotation shaft of the housing of the memory card connector of FIG. 6.
Figure 12:
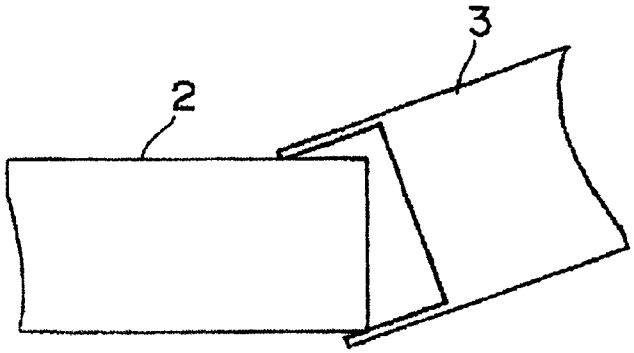
Fig. 12 PRIOR ART
FIG. 12 is a schematic plan view showing the diagonal shift of the holder cover in the memory card connector of FIG. 6.

According to this construction for memory card connector 30, first, as shown in FIG. 5(A), the user inserts his finger into protruding part 33 from window 32 of holder cover 31. By rotating holder cover 31 around rotation shaft 15, holder cover 31 is brought to an open position in which it is opened approximately 180 degrees with respect to housing 11. In this condition, the user sets the memory card (not shown) inside space 12 of housing 11.

Next, by rotating holder cover 31 with respect to housing 11 around rotation shaft 15, holder cover 31 is brought to the closed position shown in FIG. 4(A).

Hook 34 of holder cover 31 latches onto latching part 25 of housing 11, and as a result, holder cover 31 becomes locked onto housing 11.

At this time, with the memory card which has been set inside holder cover 31, the contact part contacts peaks 14*a* of the corresponding connection terminals 14 which are provided on housing 11. In addition, the contact parts are pressed against peaks 14*a* of connection terminals 14 by holder cover 31.

In this manner, the memory card, housed inside memory card connector 30 which is built into various devices such as telephones or telecommunication devices and the like, can be connected with these various devices.

In this situation, with regard to the connector insertion direction, holder cover 31, as with the previously described holder cover 20, needs only to be the minimum area needed to cover peaks 14*a* of connection terminals 14 which protrude from the surface of space 12 of housing 11 and to press the contact part of the memory card against the corresponding peak 14*a* of connection terminal 14. With regard to the connector insertion direction, or in other words, the direction of rotation shaft 15, holder cover 31 can be greatly shortened. As a result, holder cover 31 can be constructed in a small size and with a light weight.

Furthermore, by bringing holder cover 31 from the open position to the closed position by rotating around rotation shaft 15, hook 34 of holder cover 31 can be latched onto latching part 25 of housing 11, and holder cover 31 is locked onto housing 11. Holder cover 31 is locked with one motion, and the operational quality is improved.

Furthermore, in this situation, with holder cover 31, its hinge part 21 latches with rotation shaft 15 for a relatively long distance. As a result, when holder cover 31 rotates around rotation shaft 15, holder cover 31 does not become shifted diagonally with respect to rotation shaft 15, and holder cover 31 securely rotates around rotation shaft 15. The anchoring of the memory card is securely conducted.

Furthermore, with the above embodiment, there are depicted two sets of four connection terminals 14 each, but the present invention is not limited to this. The present invention can be used as a memory card connector provided with any number of connection terminals corresponding to the number of contact parts on the memory card to be used.

As described above, according to the present invention, the holder cover pivots with respect to the housing at one side edge, which is sideways with respect to the connector insertion direction. As a result, the longitudinal length of the connector of the holder cover is only the length necessary to cover the connection terminals at the part which is exposed to the surface of the housing and which is opposite the contact part of the memory card. Therefore, the holder cover can be miniaturized so that it has the minimum area and can be formed to have a light weight.

Furthermore, because the hinge part of the holder cover latches with the rotation shaft over a relatively long distance, when holder cover slides along the rotation shaft, or when it rotates around the rotation shaft, the holder cover does not become shifted diagonally with respect to the rotation shaft. The holder cover can be securely guided parallel along the rotation shaft, and the anchoring of the memory card can be conducted securely.

When the above described holder cover is equipped on the other side edge with a hook of an elastic material which can latch to a latching part provided on the other side edge of the housing, by closing the holder cover with respect to the housing, this hook latches onto the latching part of the housing, and locking of the holder cover is conducted with one motion. As a result, operational quality is improved.

Furthermore, the above holder cover is supported in a manner which allows for sliding along the above rotation shaft. When the above holder cover slides along the rotation shaft to the lock position, the latching tab of the holder cover can latch onto a projecting part on the housing. In this situation, after the holder cover is closed onto the housing, by sliding the holder cover along the rotation shaft, the holder cover is brought to a lock position, and the latching tab latches onto the projecting part. Locking is securely achieved.

In this way, by the present invention, the holder cover is constructed in a small size, and in addition, the holder cover can be easily locked to the housing. An excellent memory card connector can be provided.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A memory card connector comprising:

an elongated housing for holding a memory card;

said housing having a longitudinal axis and a transverse axis;

said transverse axis being substantially less than said longitudinal axis;

said memory card arrayed longitudinally along said housing;

said housing including connection terminal portions;

said connecting terminal portions contactable with said memory card;

a cover pivotably connected at a first of a first and second opposite cover sides to said housing along a first of a first and second opposite longitudinal sides of said housing;

said cover pivotable transversely to said longitudinal axis along only a single continuous rotational shaft to a cover closed position;

said cover closed position exposing said memory card and pressing said memory card solely along said connecting terminal portions, said cover closed position substantially covering said terminal portions said cover having at least one window structure enabling digital control of said cover;

a cooperating latching structure carried at said second cover side along said second longitudinal side for latching said cover in a latched closed position; and said shaft formed to permit longitudinal sliding of the cover between distinct operational positions.

2. A memory card connector according to claim 1 wherein:

said cooperating latching structure includes at least a hook structure carried on said cover; and a formed portion on said housing engagable with said hook structure.

3. A memory card connector according to claim 2 wherein:

said hook structure is integral with said cover;

said hook structure being a substantially U-shaped member; and said hook structure engaging at least three side sections of an engagement portion of said cooperating latch structure.

4. A memory card connector according to claim 2 further comprising:

said cover is pivotably connected to said housing;

said cover slidable longitudinally of said housing and parallel to said rotational shaft to said latched closed position;

at least one tongue tab having at least three contact surfaces on said latching structure;

at least one longitudinally spaced latching projection carried on said holder engagable with said tongue tab; and said cover in said cover closed position sliding on said holder to engage said three sides of said tongue tabs in said latching position.

5. A memory card connector according to claim 4 further comprising:

means for locking said cover in said closed latched position on said housing.

6. A memory card connector according to claim 1, further comprising:

at least two window structures for user digital control of said cover when moving said cover between open and closed positions.

7. A memory card connector according to claim 3, further comprising:

a protruding part in said cover its structure adjacent said at least one window to facilitate user digital control to said cover when actuating said cover.

8. A memory card connector according to claim 5, wherein said means for locking comprises:

at least a first and second shaft element on said rotational shaft;

said first shaft element having a substantially circular first cross-section;

said second shaft element having a substantially non-circular second cross-section;

a first and second hinge portion on said cover;

said first shaft element pivotably connecting first hinge portion to said housing through said first cross-section; and said second hinge portion slidable on said rotational shaft to engage said second shaft element, whereby said cover is locked in said latching position and prevented from rotating.

9. A memory card connector comprising:

an elongated housing for holding a memory card;

said housing having a longitudinal axis and a transverse axis;

said transverse axis being substantially less than said longitudinal axis;

said memory card arrayed longitudinally along said housing;

said housing including connection terminal portions;

said connecting terminal portions contactable with said memory card;

a cover pivotably connected at a first of a first and second opposite cover sides to said housing along a first of a first and second opposite longitudinal sides of said housing;

said cover pivotable transversely to said longitudinal axis along a single continuous rotational shaft to a cover closed position;

said cover closed position exposing said memory card and pressing said memory card solely alone said connecting terminal portions, said cover closed position substantially covering said terminal portions said cover having at least one window structure enabling digital control of said cover;

a cooperating latching structure carried at said second cover sides along said second longitudinal sides for latching said cover in a latched closed position thereof to said holder;

said cooperating latching structure includes at least a hook structure on said cover;

a formed portion on said housing engagable with said hook structure;

said cover is pivotably connected to said housing;

said cover slidable longitudinally of said housing and parallel to said rotational shaft to said latched position;

at least one tongue tab having at least three contact surfaces on said latching structure;

at least one longitudinally spaced latching projection carried on said holder engagable with said tongue tab;

said cover in said cover closed position sliding on said holder to engage said three sides of said tongue taps in said latching position;

means for locking said cover in said closed latched position on said housing;

said means for locking including at least a first and second shaft element on said rotational shaft;

said first shaft element having a substantially circular first cross-section;

said second shaft element having a substantially non-circular cross section;

a first and second hinge portion on said cover;

said first shaft element pivotably connecting said first hinge portion to said housing through said first hinge section; and said second hinge portion slidable on said rotational shaft to engage said second shaft element and permit said cover to lock in said latching position and prevent said cover from rotating.

* * * * *